US006824241B2

(12) United States Patent
Sonnichsen et al.

(10) Patent No.: US 6,824,241 B2
(45) Date of Patent: Nov. 30, 2004

(54) INK JET APPARATUS

(75) Inventors: Brian E. Sonnichsen, Lake Oswego, OR (US); Steven R. Slotto, Vancouver, WA (US); Britton Pinson, Vancouver, WA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/321,240

(22) Filed: Dec. 16, 2002

(65) Prior Publication Data

US 2004/0113968 A1 Jun. 17, 2004

(51) Int. Cl.[7] ..... B41J 2/015
(52) U.S. Cl. ..... 347/20
(58) Field of Search ..... 347/20, 92, 6; 400/124.11; 57/22

(56) References Cited

U.S. PATENT DOCUMENTS

| | | | | | |
|---|---|---|---|---|---|
| 3,822,538 | A | * | 7/1974 | Cardell | 57/22 |
| 5,276,468 | A | | 1/1994 | Deur et al. | 346/140 R |
| 5,489,925 | A | * | 2/1996 | Brooks et al. | 347/6 |
| 5,861,903 | A | | 1/1999 | Crawford et al. | 347/88 |
| 6,494,630 | B2 | * | 12/2002 | Williams et al. | 400/175 |
| 6,588,952 | B1 | * | 7/2003 | Silverbrook et al. | 400/124.11 |
| 2002/0158950 | A1 | * | 10/2002 | Altendorf | 347/92 |

* cited by examiner

*Primary Examiner*—K Feggins
(74) *Attorney, Agent, or Firm*—Manuel Quiogue

(57) ABSTRACT

A drop emitting apparatus that includes an ink jet printhead, a plurality of on-board ink reservoirs for supplying ink to the ink jet printhead, a plurality of remote ink containers, a plurality of ink supply conduits fluidically connected between the remote ink containers and the on-board ink reservoirs, and an air conduit for selectively providing compressed air to the on-board ink reservoirs.

4 Claims, 4 Drawing Sheets

INK JET APPARATUS

BACKGROUND OF THE DISCLOSURE

The subject disclosure is generally directed to ink jet printing, and more particularly to ink jet printing apparatus that includes an ink supply cable having a plurality of ink channels and an air channel.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid ink.

DETAILED DESCRIPTION OF THE DISCLOSURE

Figure 1:
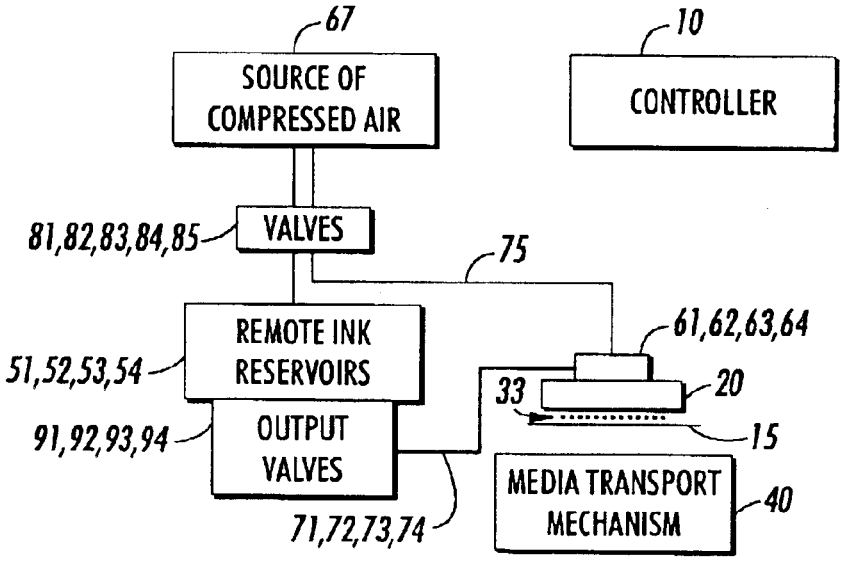
FIG. 1 is a schematic block diagram of an embodiment of an ink jet printing apparatus that includes remote ink reservoirs.
Figure 3:
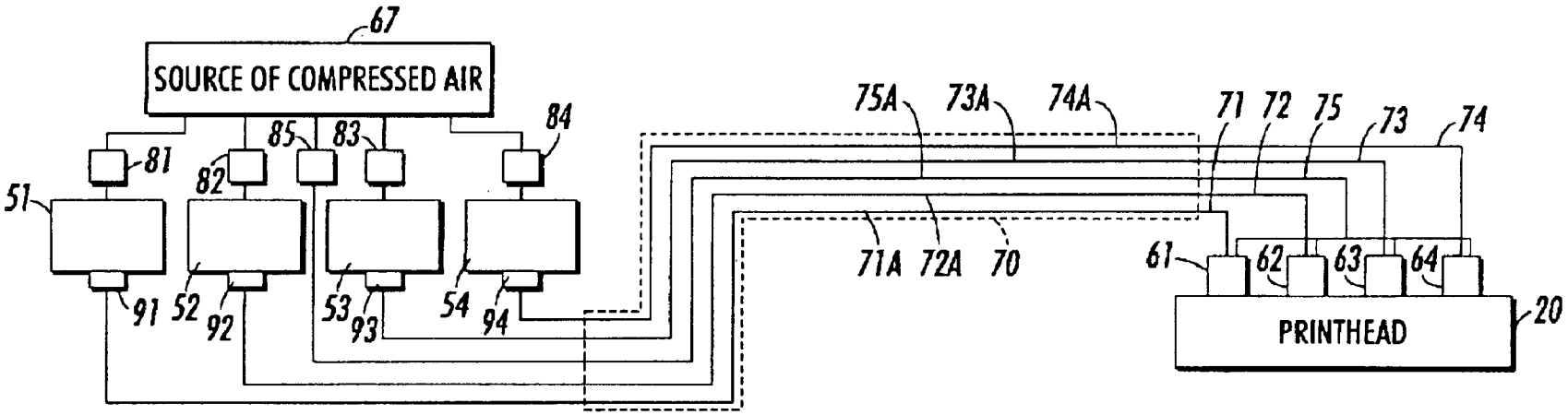
FIG. 3 is a schematic block diagram of an embodiment of ink delivery components of the ink jet printing apparatus of FIGS. 1 and 2.

FIGS. 1 and 3 are schematic block diagrams of an embodiment of an ink jet printing apparatus that includes a controller 10 and a printhead 20 that can include a plurality of drop emitting drop generators for emitting drops of ink 33 onto a print output medium 15. A print output medium transport mechanism 40 can move the print output medium relative to the printhead 20. The printhead 20 receives ink from a plurality of on-board ink reservoirs 61, 62, 63, 64 which are attached to the printhead 20. The on-board ink reservoirs 61–64 respectively receive ink from a plurality of remote ink containers 51, 52, 53, 54 via respective ink supply channels 71, 72, 73, 74. The remote ink containers 51–54 can be selectively pressurized, for example by compressed air that is provided by a source of compressed air 67 via a plurality of valves 81, 82, 83, 84. The flow of ink from the remote containers 51–54 to the on-board reservoirs 61–64 can be under pressure or by gravity, for example. Output valves 91, 92, 93, 94 can be provided to control the flow of ink to the on-board ink reservoirs 61–64.

The on-board ink reservoirs 61–64 can also be selectively pressurized, for example by selectively pressurizing the remote ink containers 51–54 and pressurizing an air channel 75 via a valve 85. Alternatively, the ink supply channels 71–74 can be closed, for example by closing the output valves 91–94, and the air channel 75 can be pressurized. The on-board ink reservoirs 61–64 can be pressurized to perform a cleaning or purging operation on the printhead 20, for example. The on-board ink reservoirs 61–64 and the remote ink containers 51–54 can be configured to contain melted solid ink and can be heated. The ink supply channels 71–74 and the air channel 75 can also be heated.

The on-board ink reservoirs 61–64 are vented to atmosphere during normal printing operation, for example by controlling the valve 85 to vent the air channel 75 to atmosphere. The on-board ink reservoirs 61–64 can also be vented to atmosphere during non-pressurizing transfer of ink from the remote ink containers 51–54 (i.e., when ink is transferred without pressurizing the on-board ink reservoirs 61–64).

Figure 2:
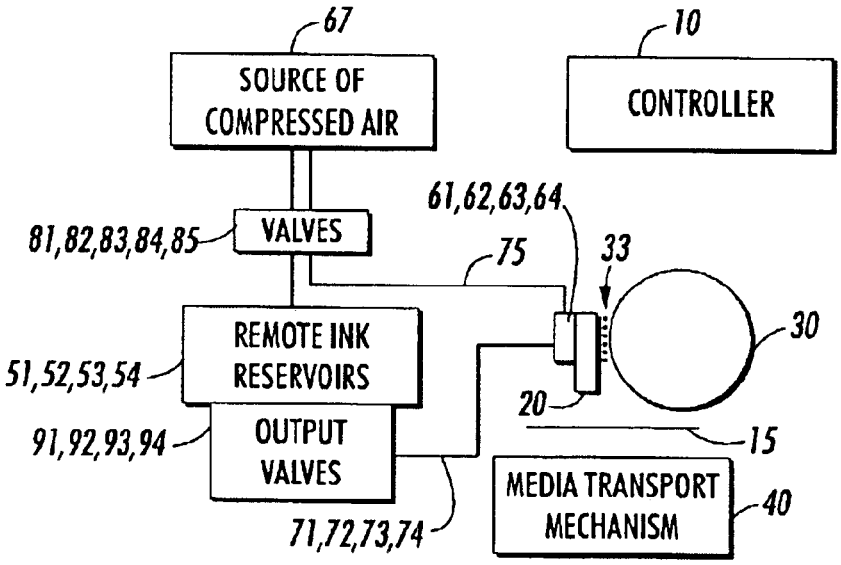
FIG. 2 is a schematic block diagram of another embodiment of an ink jet printing apparatus that includes remote ink reservoirs.

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 rollingly engages an output print medium 15 against the transfer drum 30 to cause the image printed on the transfer drum to be transferred to the print output medium 15.

As schematically depicted in FIG. 3, a portion of the ink supply channels 71–74 and the air channel 75 can be implemented as conduits 71A, 72A, 73A, 74A, 75A in a multi-conduit cable 70.

Figure 4:
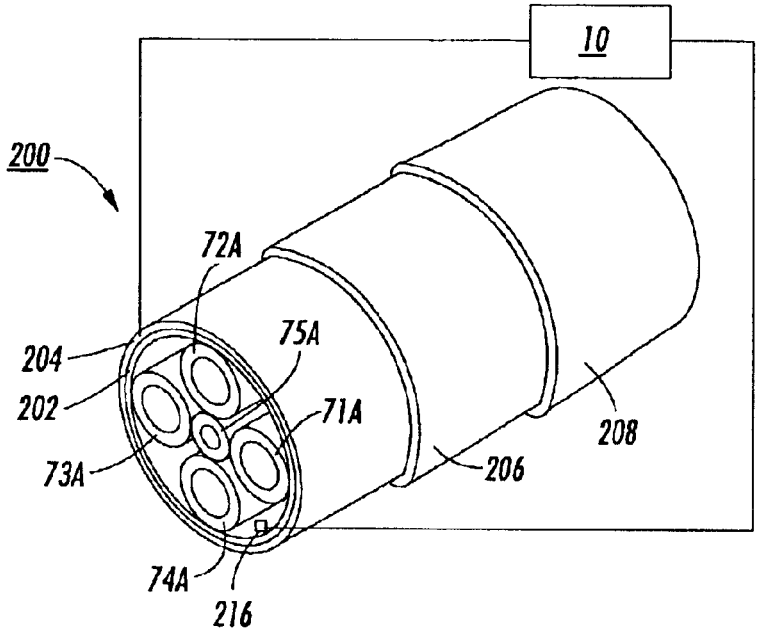
FIG. 4 is a schematic illustration of an embodiment of an ink conveying multiple conduit cable.

FIG. 4 is a schematic illustration of an embodiment of a multi-conduit cable that includes a plurality of ink supply conduits 71A, 72A, 73A, 74A and a single air conduit 75A that are wrapped by multiple layered tape 200. The ink supply conduits 71A, 72A, 73A, 74A and the single air conduit 75A can comprise silicone rubber, for example. By way of illustrative example, the ink supply conduits 71A, 72A, 73A, 74A surround the single air conduit 75A. The multiple layered tape 200 can include an inner electrically insulating layer 202, a heating element layer 204 of metal heating traces or conductors, an outer electrically insulating layer 206, and an outer thermally insulating layer 208. The multiple layered tape 200 can be wrapped helically around the conduits 71A, 72A, 73A, 74A, 75A.

The multi-conduit cable of FIG. 4 can further include a temperature sensor 216, for example for monitoring or sensing a temperature of the ink supply conduits. The temperature sensor 216 provides temperature information to the controller 10 which controls the heating element layer 204. Heating of the multi-conduit cable maintains the ink within a predetermined temperature range. Also, heating of the multi-conduit cable heats any ink that may have entered the air conduit 75A so that such ink remains in a melted state, which tends to avoid blocking the air conduit 75A. If ink that enters the air conduit 75A is not heated, such ink would solidify and block the air conduit 75A.

Figure 5:
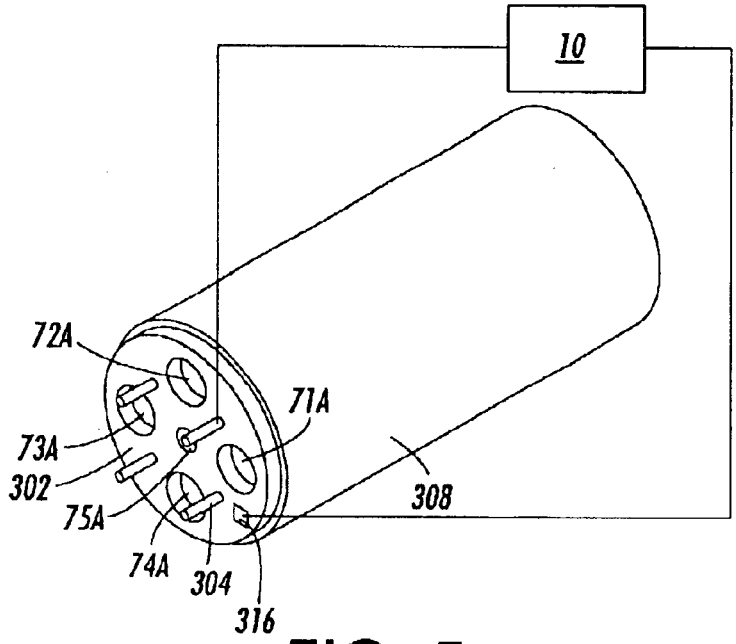
FIG. 5 is a schematic illustration of another embodiment of an ink conveying multiple conduit cable.

FIG. 5 is a schematic illustration of another embodiment of a multi-conduit cable that includes a plurality of ink supply conduits 71A, 72A, 73A, 74A and a single air conduit 75A that are formed as an integral structure in a core 302 such as silicone rubber. By way of illustrative example, the ink supply conduits 71A, 72A, 73A, 74A surround the single air conduit 75A. A thermal insulating layer 308 surrounds the core 302. The multi-conduit cable further includes heating elements 304 such as heating wires extending along the cable. The heating elements can be in the core 302 or along an outside surface of the core 302. The core 302 and the conduits contained therein can be formed by extrusion.

The multi-conduit cable of FIG. 5 can further include a temperature sensor 316, for example for monitoring or sensing a temperature of the ink supply conduits. The temperature sensor 316 provides temperature information to the controller 10 which controls the heating elements 304. Heating of the multi-conduit cable maintains the ink within a predetermined temperature range. Also, heating of the multi-conduit cable heats any ink that may have entered the air conduit 75A so that such ink remains in a melted state, which tends to avoid blocking the air conduit 75A. If ink that enters the air conduit 75A is not heated, such ink would solidify and block the air conduit 75A.

Figure 6:
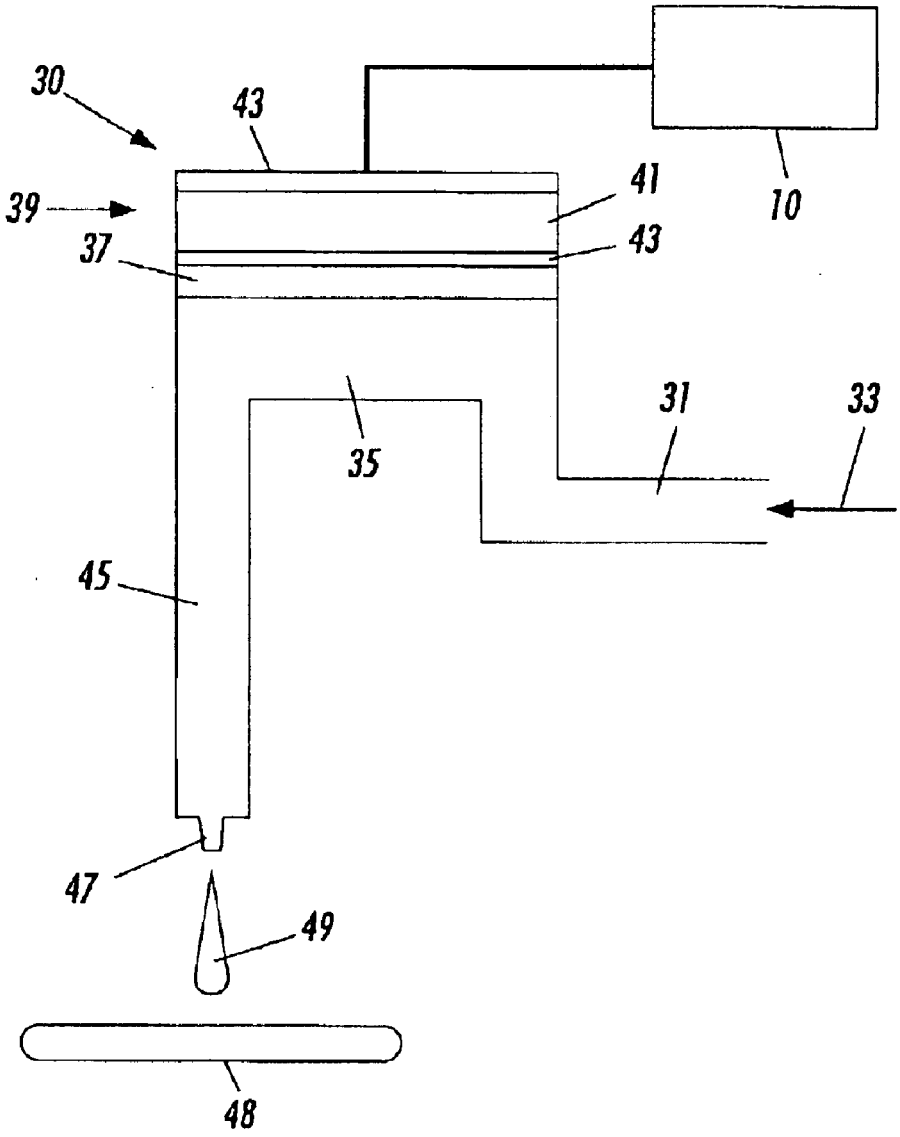
FIG. 6 is a schematic block diagram of an embodiment of a drop generator that can be employed in the printhead of the ink jet printing apparatus of FIG. 1 and in the printhead of the ink jet printing apparatus of FIG. 2.

FIG. 6 is a schematic block diagram of an embodiment of a drop generator 30 that can be employed in the printhead 20 of the printing apparatus shown in FIG. 1 and the printing apparatus shown in FIG. 2. The drop generator 30 includes an inlet channel 31 that receives melted solid ink 33 from a manifold, reservoir or other ink containing structure. The melted ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface or a print output medium, for example. The outlet channel 45 can include a nozzle or orifice 47.

The invention has been described with reference to disclosed embodiments, and it will be appreciated that variations and modifications can be affected within the spirit and scope of the invention.

What is claimed is:

1. A drop emitting apparatus comprising:

an ink jet printhead;

a plurality of on-board ink reservoirs for supplying ink to the ink jet printhead;

a plurality of remote ink containers;

a plurality of ink supply conduits fluidically connected between the remote ink containers and the on-board ink reservoirs;

an air conduit for selectively providing compressed air to the on-board ink reservoirs;

the plurality of ink supply conduits and the air conduit arranged in a multi-conduit cable; and wherein the multi-conduit cable includes a tape wrap.

2. A drop emitting apparatus comprising:

an ink jet printhead;

a plurality of on-board ink reservoirs for supplying ink to the ink jet printhead;

a plurality of remote ink containers;

a plurality of ink supply conduits fluidically connected between the remote ink containers and the on-board ink reservoirs;

an air conduit for selectively providing compressed air to the on-board ink reservoirs;

the plurality of ink supply conduits and the air conduit arranged in a multi-conduit cable; and wherein the multi-conduit cable includes a tape wrap having a heating element layer.

3. A drop emitting apparatus comprising:

a piezo-electric ink jet printhead;

a plurality of on-board ink reservoirs for supplying melted solid ink to the ink jet printhead;

a plurality of remote ink containers for containing melted solid ink;

a plurality of ink supply conduits fluidically connected between the remote ink containers and the on-board ink reservoirs;

an air conduit for selectively providing compressed air to the on-board ink reservoirs;

the plurality of ink supply conduits and the air conduit arranged in a multi-conduit cable;

a heating structure for heating the ink supply conduits and the air conduit; and wherein the multi-conduit cable includes a tape wrap.

4. A drop emitting apparatus comprising:

a piezo-electric ink jet printhead;

a plurality of on-board ink reservoirs for supplying melted solid ink to the ink jet printhead;

a plurality of remote ink containers for containing melted solid ink;

a plurality of ink supply conduits fluidically connected between the remote ink containers and the on-board ink reservoirs;

an air conduit for selectively providing compressed air to the on-board ink reservoirs;

the plurality of ink supply conduits and the air conduit arranged in a multi-conduit cable;

a heating structure for heating the ink supply conduits and the air conduit; and wherein the multi-conduit cable includes a tape wrap having a heating element layer.

* * * * *